US011425969B2

(12) United States Patent
Li

(10) Patent No.: US 11,425,969 B2
(45) Date of Patent: Aug. 30, 2022

(54) MAGNETIC BUCKLE

(71) Applicant: LIAN YANG PLASTIC (SHEN ZHEN) CO., LTD., Shenzhen (CN)

(72) Inventor: Qiuzong Li, Shenzhen (CN)

(73) Assignee: LIAN YANG PLASTIC (SHEN ZHEN) CO., LTD., Shenzhen (CN)

( * ) Notice: Subject to any disclaimer, the term of this patent is extended or adjusted under 35 U.S.C. 154(b) by 0 days.

(21) Appl. No.: 17/279,091

(22) PCT Filed: Feb. 24, 2020

(86) PCT No.: PCT/CN2020/076448

§ 371 (c)(1),
(2) Date: Mar. 23, 2021

(87) PCT Pub. No.: WO2020/173410

PCT Pub. Date: Sep. 3, 2020

(65) Prior Publication Data

US 2022/0047045 A1 Feb. 17, 2022

(30) Foreign Application Priority Data

Feb. 27, 2019 (CN) ..... 201910147794.7
Aug. 22, 2019 (CN) ..... 201910778260.4
Sep. 2, 2019 (CN) ..... 201910824600.2

(51) Int. Cl.
*A44B 11/26* (2006.01)

(52) U.S. Cl.
CPC ..... *A44B 11/266* (2013.01); *A44D 2203/00* (2013.01)

(58) Field of Classification Search
CPC .. A44B 11/266; A44B 11/258; A44D 2203/00
See application file for complete search history.

(56) References Cited

U.S. PATENT DOCUMENTS 9,555,935 B2 * 1/2017 Fiedler ..... A44B 11/258
2015/0327631 A1 * 11/2015 Kaneko ..... A44B 11/266 24/665
2019/0174875 A1 * 6/2019 Cheng ..... B62B 9/24
2021/0015217 A1 * 1/2021 Cheng ..... A44B 11/2519

* cited by examiner

*Primary Examiner* — Robert Sandy

(57) ABSTRACT

A magnetic buckle including a buckle base assembly and a locking assembly is disclosed. A first magnet and an adjustable lock hole are disposed on buckle base assembly, a lock tongue and a second magnet are disposed on locking assembly, two moving portions are disposed at the buckle base assembly respectively, and two unlocking portions are disposed within the buckle base assembly. When the lock hole is close to the lock tongue, the first magnet attracts the second magnet to guide the lock tongue into the lock hole to achieve locking. When the moving portions are pressed toward each other, the unlocking portions move toward the lock tongue to separate the parts of the lock tongue combined with the buckle base assembly for reducing an attractive force between the first magnet and the second magnet, so as to facilitate separation between the buckle base assembly and the locking assembly.

20 Claims, 13 Drawing Sheets

MAGNETIC BUCKLE

BACKGROUND OF THE INVENTION

Field of the Invention

The present invention relates to a buckle, in particular to a magnetic buckle that is easy to operate and conforms to ergonomics.

Description of Related Art

Some parts of children's products such as child strollers, child safety seats, and infant carriers usually need to be connected or maintained in a certain state through buckles. For example, the infant carrier needs to be connected and loosened, so this variable state connection can be realized through buckles. Normally, most of the buckles are plug-in safety buckles. This plug-in safety buckle requires the user to align and lock the mating male buckle and female buckle with both hands to achieve a safe connection. However, users often need to hold the child in one hand and operate the safety buckle with the other hand. Therefore, this kind of plug-in safety buckle is relatively inconvenient to operate, and it cannot meet requirements of various scenarios. Thus, magnetic buckles are gradually used to solve this problem.

The magnetic buckle is a kind of buckle that is locked by magnetic attraction, which typically includes a buckle base and a lock, each of which is equipped with magnets. When the above two are close to each other, the position may be corrected and the two may be quickly combined together under the action of magnetic attraction. For this kind of magnetic buckle, since it is corrected in direction and attracted by magnetic force, it does not require the user to align, and the user can operate with one hand. Thus, it is convenient in use. For this kind of magnetic buckle, although the positioning and locking of the buckle is realized by the correction in direction with the help of magnetic force, the attraction between the magnets also makes it necessary to resist the magnetic force when unlocking.

The existing magnetic buckles have various unlocking methods. For example, the unlocking is performed by pressing and lifting. When unlocking, first the unlocking member is pressed to unlock the buckle, and then one side of the buckle is lifted up so that one end of the magnet is spaced apart, and the entire buckle is separated after weakening the attractive force between the magnets. For this kind of magnetic buckle, it has to be pressed hard to unlock, which either requires both hands to operate to unlock, or will apply pressure on the occupant as well as with the help of lifting, and the magnetic force has to be overcome so that a greater force is required to lift to unlock during lifting; therefore, the actual operation is not convenient and laborious.

Another conventional unlocking method is to displace the magnet by sliding and then separate the buckle. On the one hand, this kind of magnetic buckle has to provide space for the magnet to be displaced, so that the volume is relatively large and the aesthetics has to be improved; on the other hand, the most familiar method in daily life is the pressing and unlocking method, and the operation method of displacing the magnet by sliding does not conform to daily habits of the public to unlock so that it is difficult to know how to unlock for users who use it for the first time; therefore, there may be security risks in some scenarios.

In summary, although the existing magnetic buckles are convenient to lock, the unlocking methods still need to be improved, so as to be more in line with daily habits of the public, and to be more labor-saving and easy to operate.

SUMMARY OF THE INVENTION

The present invention aims to solve the above-mentioned problems, which provides a convenient and ergonomic magnetic buckle.

In order to achieve the above objective, a magnetic buckle is provided in the present invention. The magnetic buckle includes a buckle base assembly and a locking assembly, wherein a first magnet and an adjustable lock hole are disposed on the buckle base assembly, a lock tongue capable of insertion into the lock hole and a second magnet are disposed on the locking assembly, two moving portions are disposed at two opposite sides of the buckle base assembly respectively, two unlocking portions linked by the two moving portions are disposed within the buckle base assembly, and the unlocking portions face the lock hole. When the lock hole of the buckle base assembly is close to the lock tongue of the locking assembly, the first magnet attracts the second magnet to guide the lock tongue into the lock hole to achieve locking. When the moving portions are pressed toward each other, the unlocking portions move toward parts of the lock tongue combined with the buckle base assembly to separate the parts of the lock tongue combined with the buckle base assembly for reducing an attractive force between the first magnet and the second magnet, so as to facilitate separation between the buckle base assembly and the locking assembly.

Further, the buckle base assembly is provided with a functional portion linked by the moving portion to force the lock hole to expand. When the moving portion is operated to unlock, the functional portion forces the lock hole to expand for assisting the lock tongue to disengage from the lock hole.

Further, the unlocking portion is respectively arranged on an inner wall of the moving portion and protrudes from the inner wall of the moving portion, and a free end of the unlocking portion is provided with a guiding wedge surface.

Further, the moving portion includes a first moving portion and a second moving portion, two first connecting arms are symmetrically disposed at two sides of the first moving portion, and the first connecting arm is integrally formed with the first moving portion. Two second connecting arms are symmetrically disposed at two sides of the second moving portion, and the second connecting arm is integrally formed with the second moving portion. The first connecting arm and the second connecting arm are in a disconnected relationship, which forms a connecting arm with a symmetrical structure. The first moving portion, the first connecting arm, the second connecting arm and the second moving portion are enclosed in an enclosed shape.

Further, the moving portion includes the first moving portion and the second moving portion, the first moving portion is connected to the second moving portion by the connecting arm. The first moving portion, the connecting arm and the second moving portion are formed integrally with each other or connected integrally with each other in a ring shape with elasticity.

Further, adjusting portions capable of adjusting a size of the lock hole are respectively disposed within the connecting arm, and the adjusting portions are in the enclosed shape with an adjusting hole for adjusting the size of the lock hole formed therebetween.

Further, an elastic arm is disposed between the connecting arm and the adjusting portion respectively, the elastic arm is in an arched shape with elasticity, and the elastic arm has one end connected to the connecting arm and the other end connected to the adjusting portion.

Further, the adjusting portion is provided with a pressure receiving portion, and the connecting arm is provided with a pressing portion. When the moving portions are pressed toward each other for unlocking, an end of the pressing portion acts on the pressure receiving portion to press the pressure receiving portion to force the adjusting portion to expand outward, such that the lock hole is forced to expand.

Further, the pressure receiving portion is provided with a pressing surface. The pressure receiving portion is symmetrically disposed on the adjusting portion, and the pressing portion is symmetrically disposed on the connecting arm.

Further, the pressing portion is located between the elastic arm and the unlocking portion. The elastic arm, the pressing portion and the unlocking portion are located at a periphery of the adjusting portion respectively.

Further, the buckle base assembly is provided with a blocking portion, and the blocking portion is disposed between the first connecting arm and the second connecting arm to separate the first connecting arm from the second connecting arm. When the first moving portion or the second moving portion is pressed alone, an end of the first connecting arm or the second connecting arm presses the blocking portion to partially expand the lock hole for not being unlocked. When the first moving portion and the second moving portion are simultaneously pressed, two ends of the first connecting arm and the second connecting arm press the blocking portion simultaneously to expand the lock hole evenly for being unlocked.

Further, the buckle base assembly is provided with a limit portion that limits a moving direction of the moving portion, the unlocking portion is provided with a limit hole arranged along the moving direction of the moving portion, and the limit hole is matched with the limit portion.

Further, a guiding portion for preventing the lock tongue from tilting relative to a locking direction is disposed in the lock hole.

Further, the buckle base assembly includes a seat, the seat is provided with a fixing through hole, the adjusting hole is directly opposite to the fixing through hole, and the adjusting hole and the fixing through hole form the lock hole. In a default state, an inner diameter of the adjusting hole is smaller than an inner diameter of the fixing through hole. When the moving portions are pressed toward each other, the adjusting portion expands outward so that the inner diameter of the adjusting hole is larger than the inner diameter of the fixing through hole.

Further, the lock tongue includes a columnar portion protruding from the locking assembly and a flange portion arranged at a free end of the columnar portion, and a clamping step is formed between the flange portion and the columnar portion. When the lock tongue enters the lock hole, the flange portion presses the adjusting portion to enter the lock hole, and the adjusting portion is clamped at the clamping step to limit the lock tongue from actively escaping from the lock hole.

Further, an edge of the adjusting portion is provided with a first guide inclined surface that is flared toward the fixing through hole, and an outer wall of the flange portion is provided with a second guide inclined surface in a narrowing shape.

Further, the first magnet is directly opposite to the lock hole and is spaced apart from the lock hole, and the second magnet is directly opposite to the lock tongue.

Further, the buckle base assembly includes a magnet fixing base, the magnet fixing base is provided with a first magnet mounting slot, wherein a position of the first magnet mounting slot is directly opposite to the lock hole, an opening direction of the first magnet mounting slot is opposite to the lock hole, and the first magnet is arranged in the first mounting slot.

Further, an inner wall of the seat facing the adjusting hole is provided with a plurality of guiding portions, the guiding portions are distributed on a periphery of the fixing through hole, and ends of the guiding portions face the fixing through hole. The guiding portions are formed integrally with the seat, the guiding portions are protruded from the inner wall of the seat and are distributed circumferentially along the fixing through hole, and the ends of the guiding portions are flush with a circumferential wall of the fixing through hole.

Further, a top of the guiding portion is provided with a magnet fixing portion formed or connected integrally therewith, and the magnet fixing portion is directly opposite to the fixing through hole and is spaced apart from the fixing through hole. A first magnet mounting slot is disposed on the magnet fixing portion, and the first magnet is mounted in the first magnet mounting slot.

Further, an inner portion of the lock tongue is hollow to form a second magnet mounting slot, and the second magnet is mounted in the second magnet mounting slot.

The beneficial effect of the present invention is that: it effectively solves the above problems. The magnetic buckle of the present invention is provided with moving portions that are pressed oppositely with dual-directional operations, which is ergonomic and simple to operate. Moreover, when the moving portions are pressed in two directions, the unlocking portion disposed inside may be inserted between the parts where the lock tongue is combined with the buckle base assembly, thereby reducing the attraction between the magnets and facilitating user to separate the lock tongue from the lock hole quickly and effortlessly in the next step to achieve the unlocking effect. In addition, in the present invention, through the provision of the connecting arm and the elastic arm, the adjusting portion may not only expand in the radial direction but also move in the axial direction, so that the lock tongue may easily press the adjusting portion into the lock hole under the action of a small magnetic attraction, thereby reducing requirements for the magnetic strength of the first magnet and the second magnet. Further, in the present invention, by arranging the free end of the unlocking portion into a wedge surface shape, it may not only be pressed between the lock tongue and the bottom of the first magnet mounting slot for separation to greatly reduce the magnetic attraction, but also may move the first magnet away from the lock hole first to drive the lock tongue upward, so that the lock tongue may not compress the adjusting portion but facilitates the expansion of the adjusting portion to expand the adjusting hole for unlocking, thereby greatly reducing the unlocking force. Further, in the present invention, the provision of the functional portion may force the lock hole to expand, avoiding the lock hole from being pressed and unable to expand in time when the locking force is too large. In the present invention, the function portion disposed inside may ensure the smooth expansion of the lock hole during unlocking, so that the lock tongue may be smoothly released from the lock hole for unlocking. Further, in the present invention, by dividing the button linkage into two members, the problem of unlocking in one direction may be solved to avoid pressing one side to unlock, which may greatly improve safety of use. For the magnetic buckle of the present invention, not only the operation is humanized, but the force required for unlocking is small and the operation is very labor-saving as well as avoiding failure in unlocking, with strong practicability and vigorous promotion. The magnetic buckle of the present invention may be widely applied to parts that need to be connected in a variable state, such as child safety seats, child strollers, backpacks, suitcases, etc., and is especially suitable for infant carriers.

BRIEF DESCRIPTION OF THE DRAWINGS

Aspects of the present invention are best understood from the following detailed description when read with the accompanying figures. The exemplary embodiments of the present invention and the description thereof are used to explain the present invention, and do not constitute improper limitations on the preset invention. In the drawings.

DESCRIPTION OF THE PREFERRED EMBODIMENTS

In order to enable the above objects, features and advantages of the disclosure to be more apparent and easily understood, the specific embodiments of the disclosure will be further elaborated hereafter in connection with the drawings.

The following embodiments are further explanations and supplements to the present invention, and do not constitute any limitation to the present invention.

As shown in FIGS. 1 to 13, one main point of the magnetic buckle of the present invention lies in pressing on both sides to unlock, wherein when pressed, an internal unlocking portion 142 may be inserted between two portions attracted by magnets to separate the two portions to weaken the magnetic force of the magnets, thereby facilitating unlocking. In addition, the other main point of the magnetic buckle of the present invention lies in that a functional portion disposed inside the magnetic buckle may force a lock hole 17 to expand, so as to facilitate the unlocking, thereby avoiding jamming and other failures and helping reduce the unlocking force.

Figure 1:
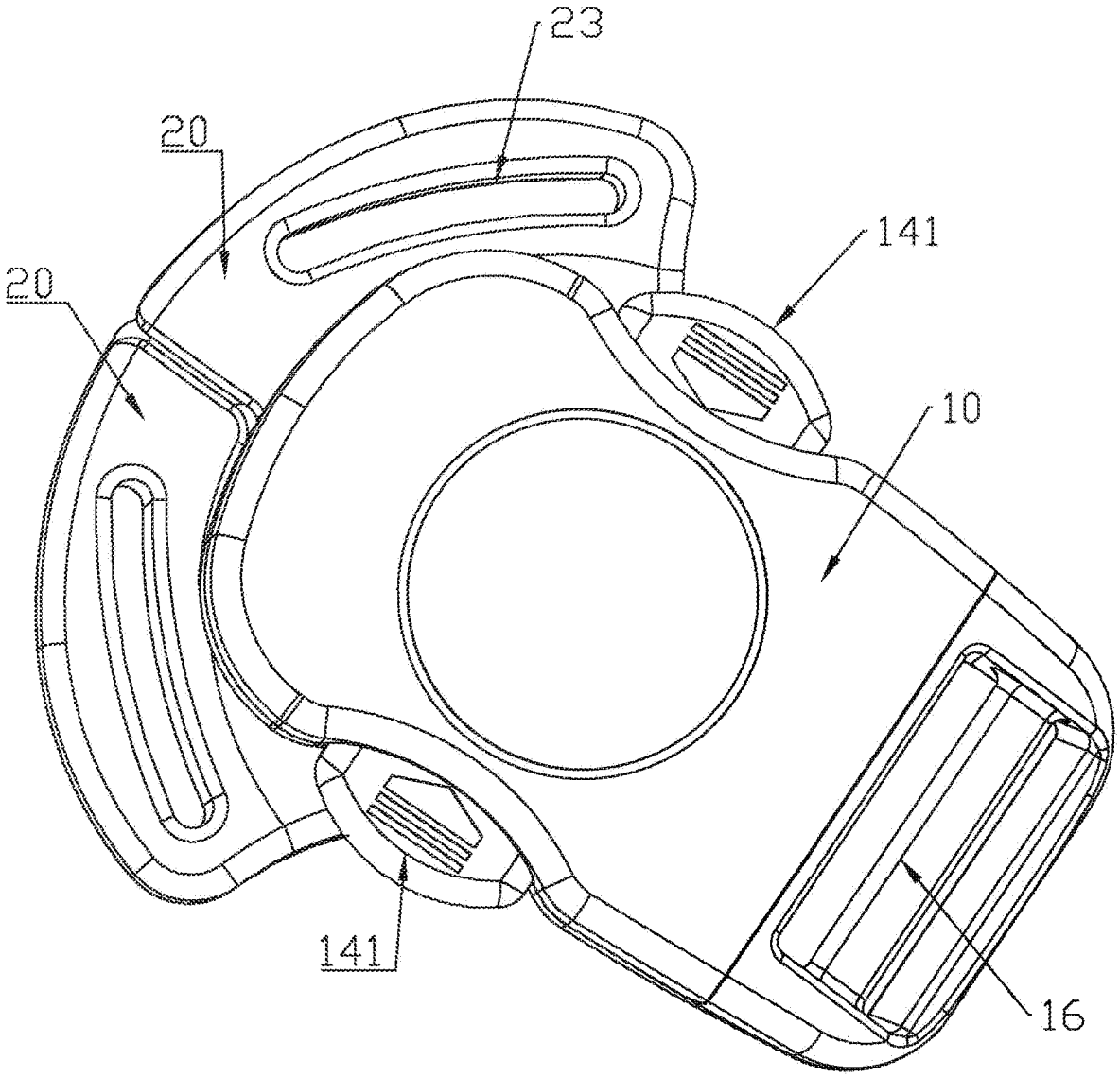
FIG. 1 is an overall structural diagram of a magnetic buckle of the present invention.
Figure 2:
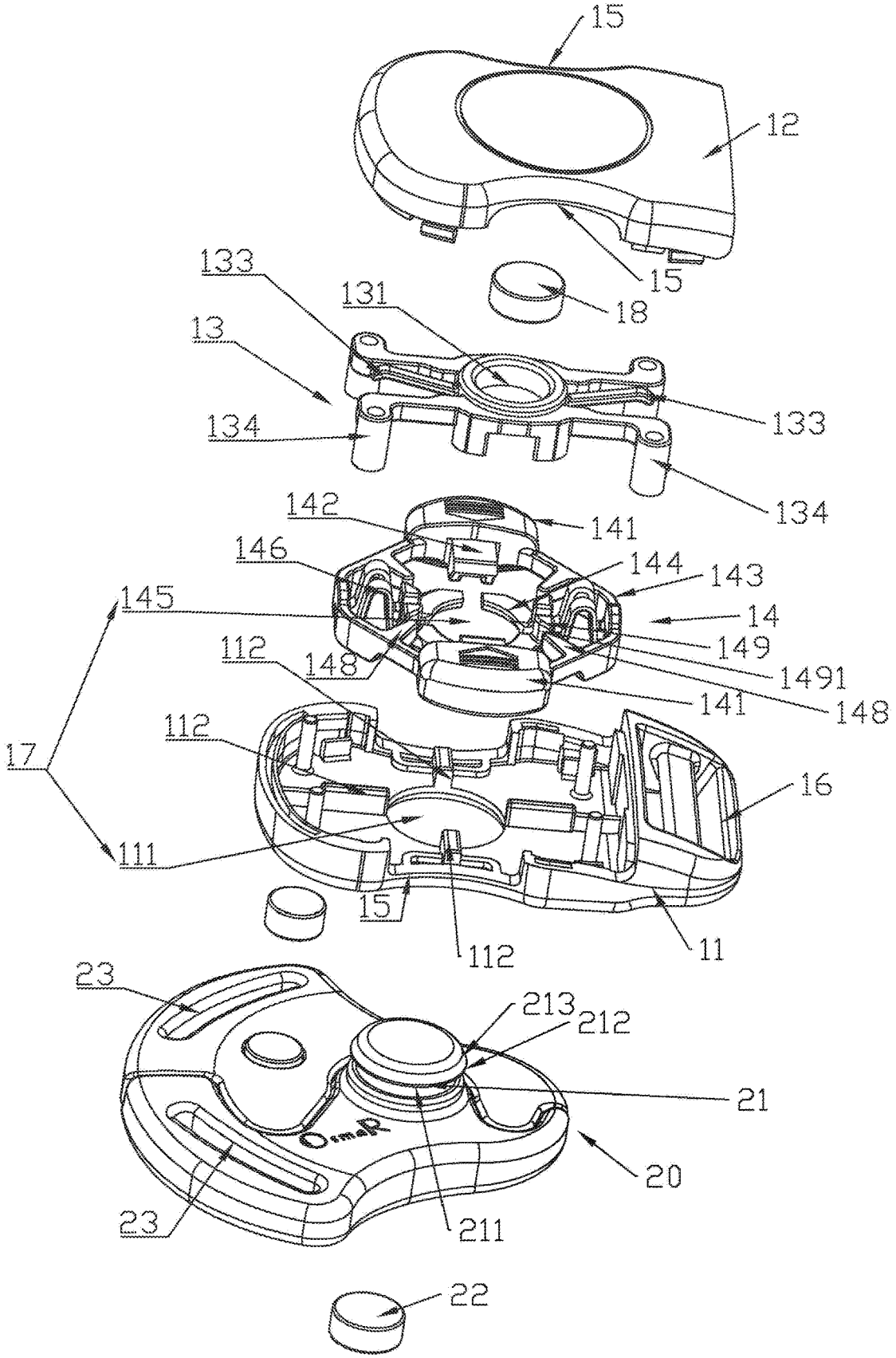
FIG. 2 is an exploded diagram of an overall structure of a magnetic buckle of the present invention.
Figure 3:
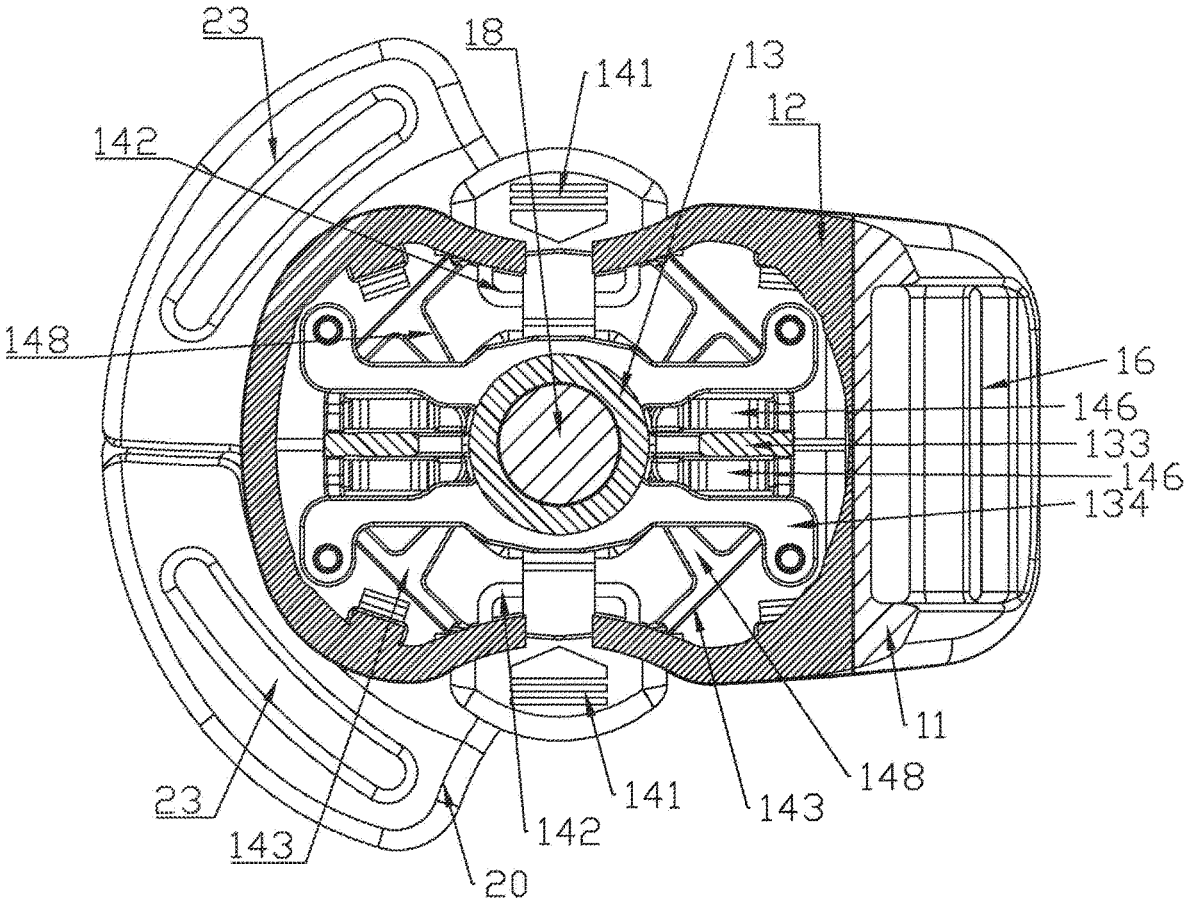
FIG. 3 is a cross-sectional view of the structure shown in FIG. 2.
Figure 4:
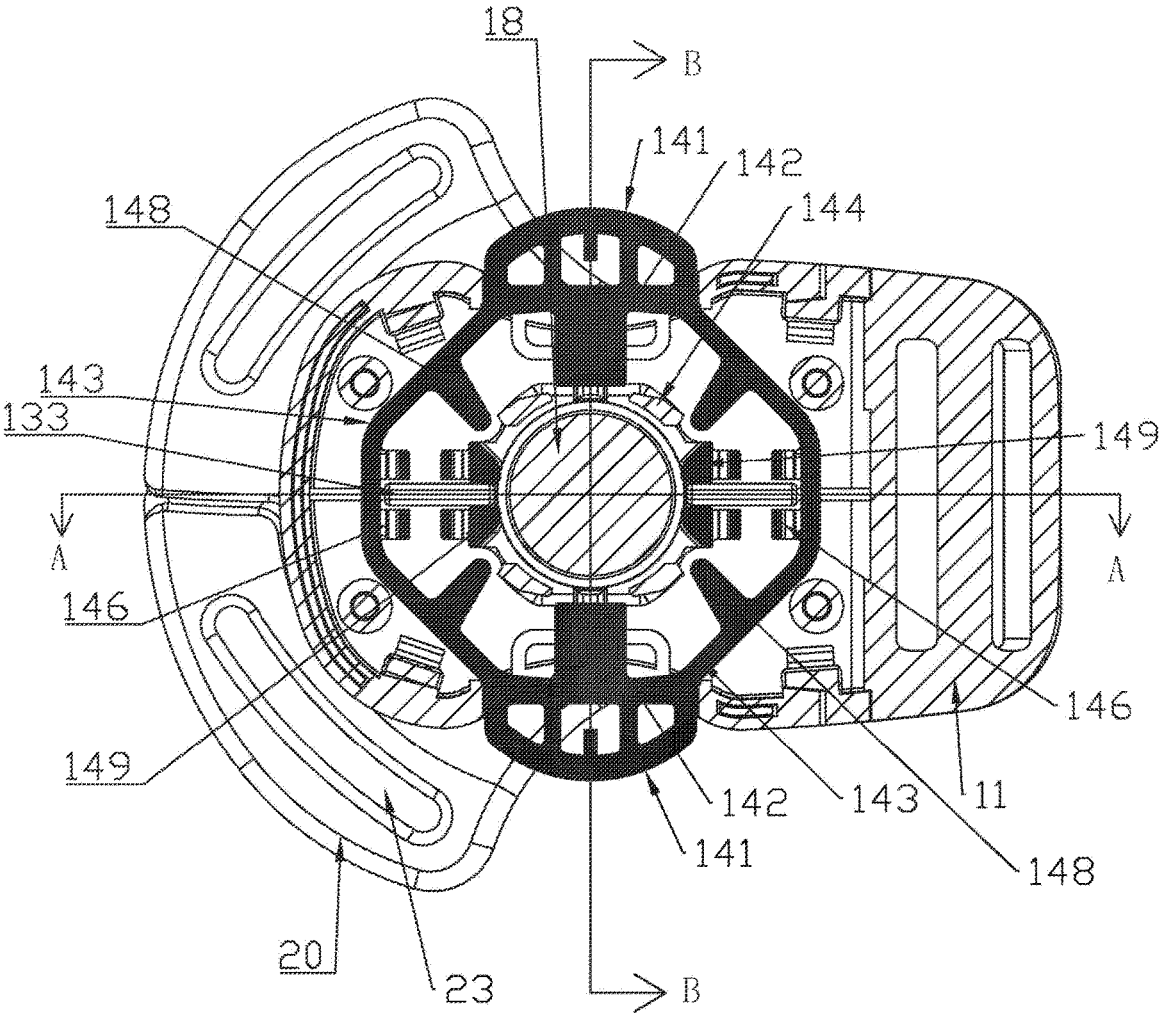
FIG. 4 is a cross-sectional view of the structure shown in FIG. 2.
Figure 9:
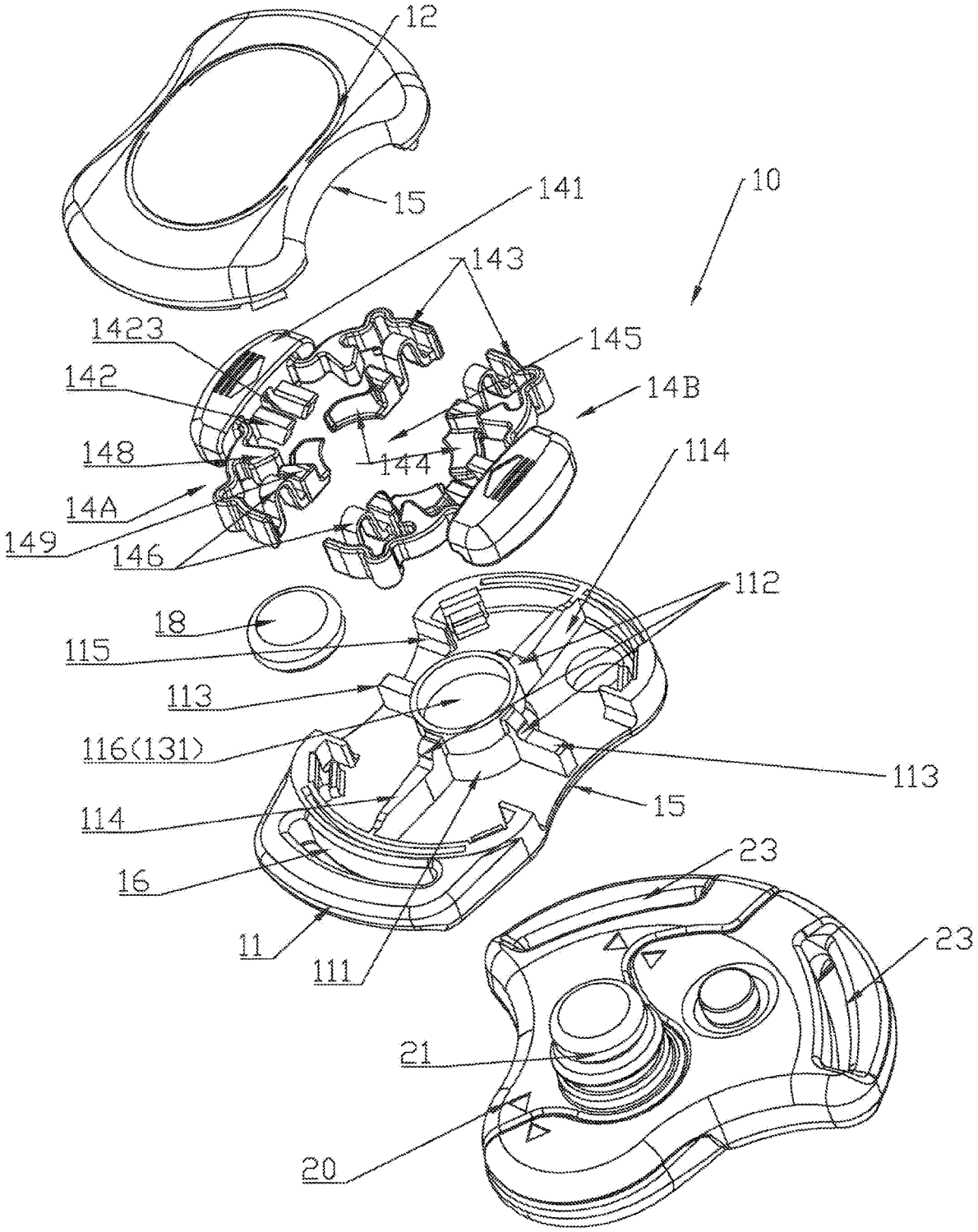
FIG. 9 is another exploded diagram of an overall structure of a magnetic buckle of the present invention.
Figure 10:
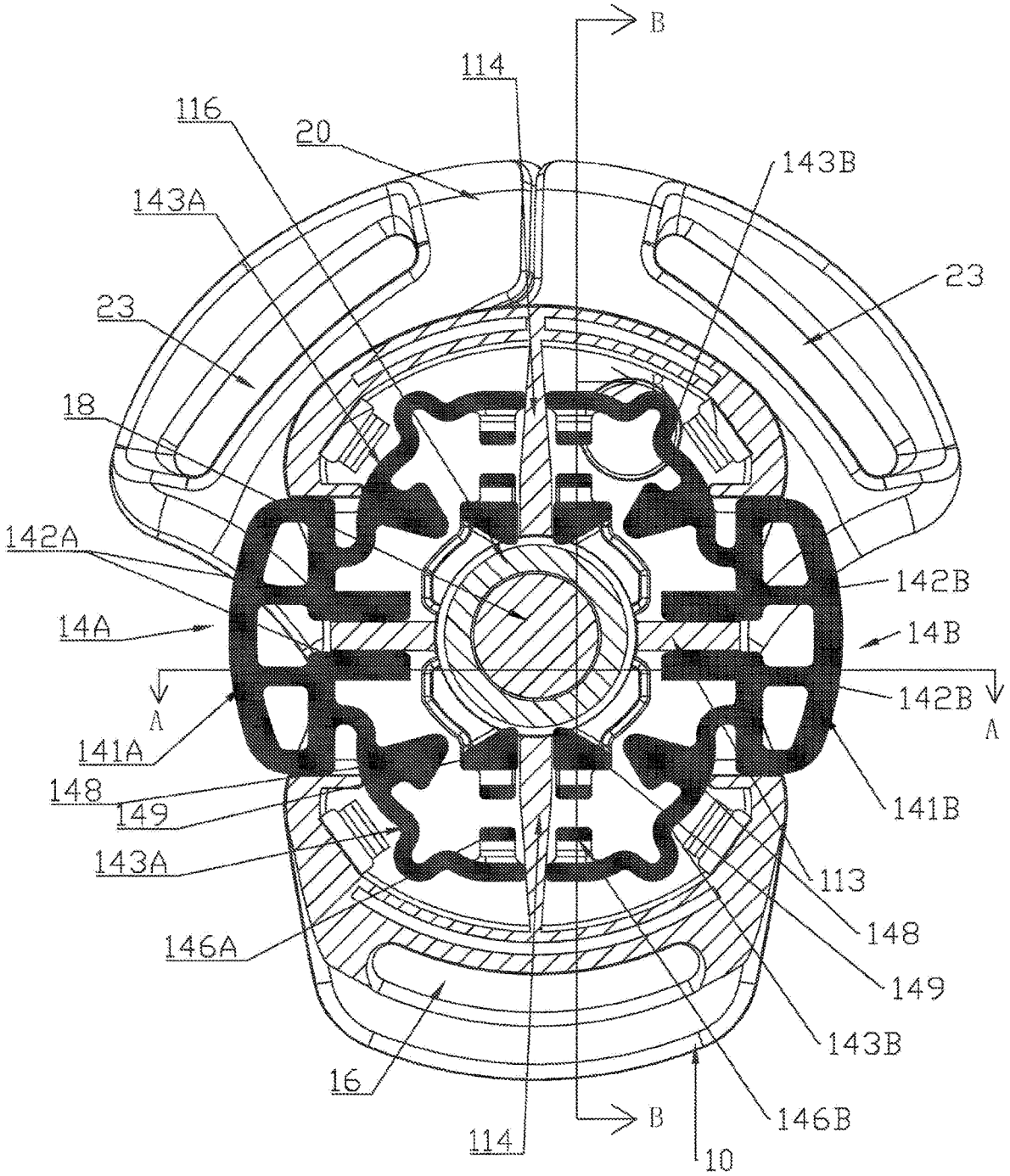
FIG. 10 is a cross-sectional view of the structure shown in FIG. 9.
Figure 11:
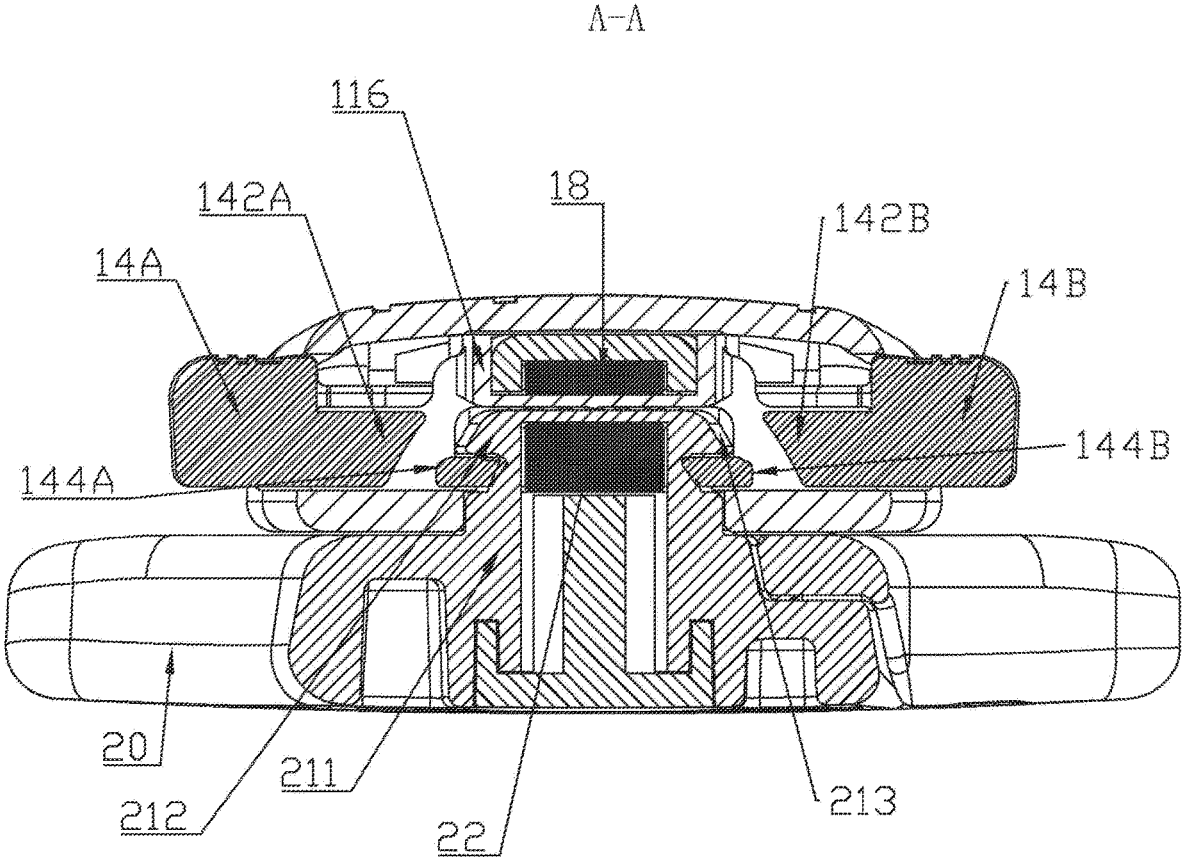
FIG. 11 is a longitude-sectional view along a direction A-A in FIG. 10.
Figure 12:
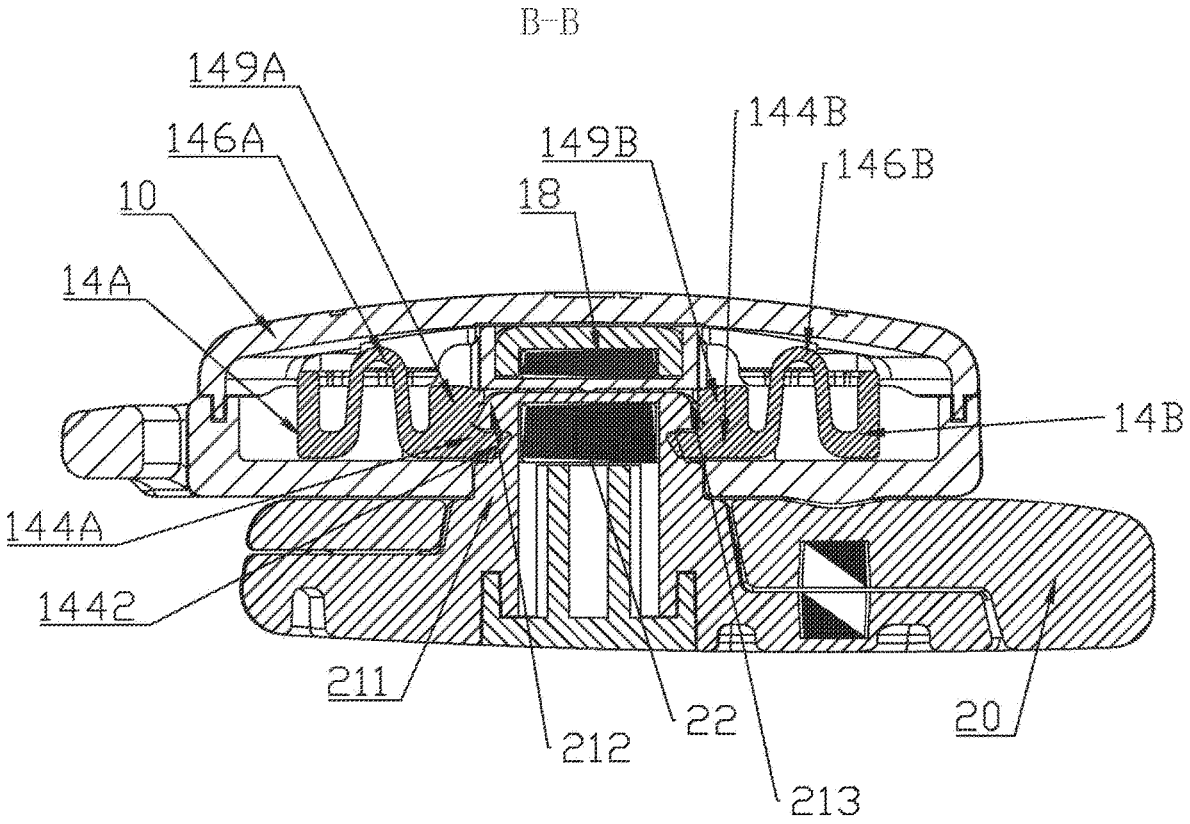
FIG. 12 is a longitude-sectional view along a direction B-B in FIG. 10.
Figure 13:
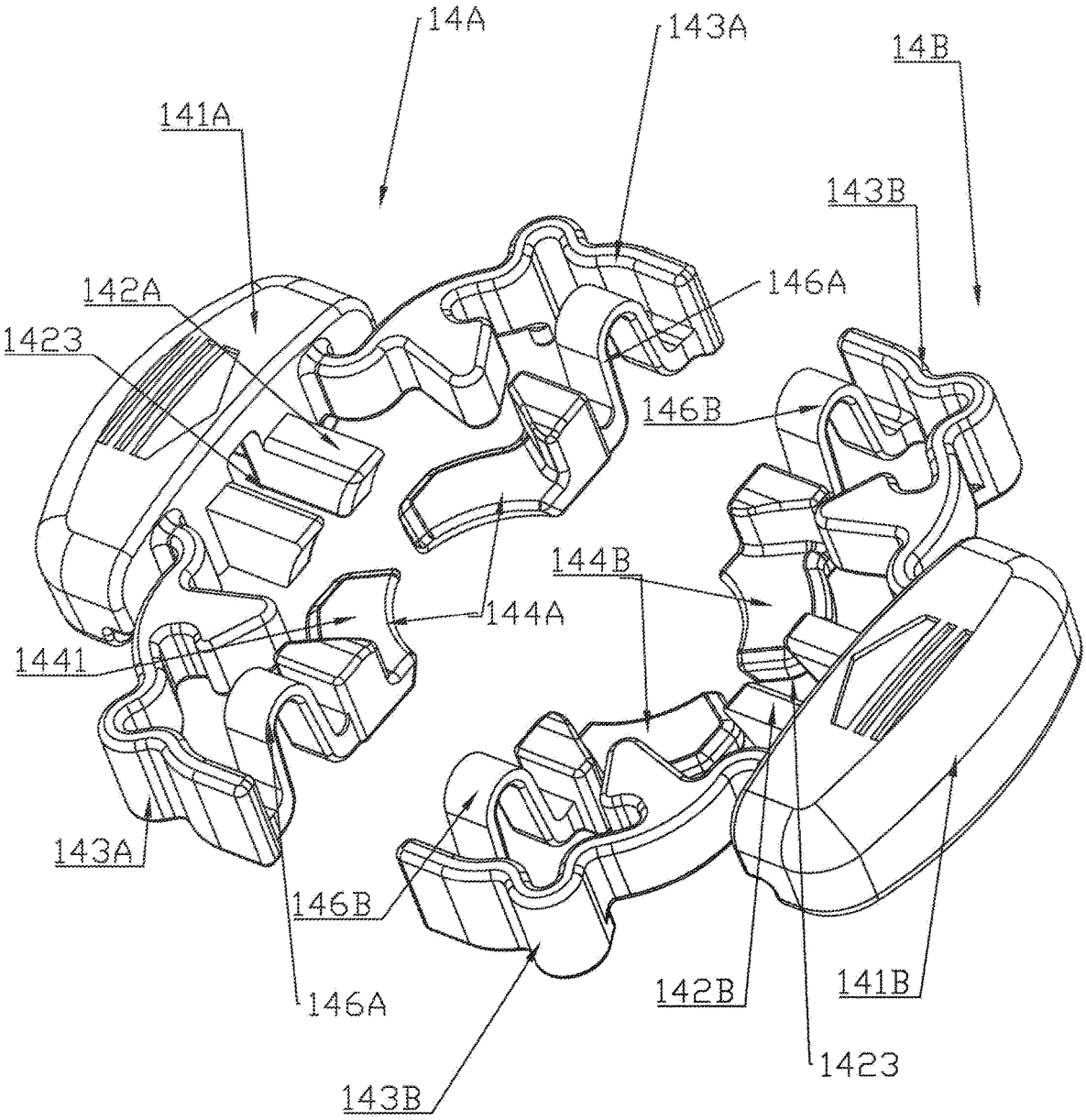
FIG. 13 is a diagram showing a structure when a button linkage is divided into two.

Specifically, as shown in FIGS. 1, 2 and 9, a magnetic buckle of the present invention includes a buckle base assembly 10 and a locking assembly 20.

As shown in FIGS. 2 and 9, the buckle base assembly 10 includes a seat 11, an upper cover 12 and a button linkage 14. In some embodiments, as shown in FIG. 2, the buckle base assembly 10 further includes a magnet fixing base 13.

As shown in FIGS. 1 to 13, the seat 11 is engagedly connected to the upper cover 12, with a space formed therebetween. The shapes of the seat 11 and the upper cover 12 may be set according to requirements. The engaged connection between the seat 11 and the upper cover 12 may refer to the known technology, which may be connected by means of buckle, screw fixing, etc. In this embodiment, the seat 11 is engagedly connected to the upper cover 12 by a screw. In order to facilitate pressing on both sides oppositely, button holes 15 are respectively arranged on the opposite sides of the seat 11 and the upper cover 12, and are used to make the moving portion 141 of the button linkage 14 extend to the outside of the seat 11 and the upper cover 12 to facilitate the user to press.

As shown in FIGS. 1 to 13, in order to facilitate the connection of webbings, a first webbing hole 16 is disposed on the seat 11 or the upper cover 12. In this embodiment, the first webbing hole 16 is disposed on the seat 11.

As shown in FIGS. 2 and 9, in order to facilitate the locking of the lock tongue 21, a fixing through hole 111 is disposed on the seat 11. The size and shape of the fixing through hole 111 may be set according to requirements. In this embodiment, the fixing through hole 111 is preferably a circular hole. The fixing through hole 111 is one part of the lock hole 17.

As shown in FIGS. 2 and 9, in order to prevent the lock tongue 21 from tilting when it moves, a guiding portion 112 is disposed on an inner surface of the seat 11. In this embodiment, the guiding portion 112 is integrally formed with the seat 11, and protruded from a side surface of the seat 11 facing the upper cover 12. The guiding portion 112 is distributed on a periphery of the fixing through hole 111, and an end of the guiding portion 112 faces the fixing through hole 111, so that a barrier is formed on an inner side of the fixing through hole 111 to prevent the lock tongue 21 from tilting when inserted and removed, thereby facilitating locking and unlocking. In some embodiments, as shown in FIGS. 2 and 9, the guiding portion 112 is in a convex strip shape, which is distributed on the periphery of the fixing through hole 111 in a circumferential interval, and the end of the guiding portion 112 is flush with a circumferential inner wall of the fixing through hole 111.

In some embodiments, in order to limit a movement direction of the button linkage 14, a limit portion 113 is disposed on the seat 11. As shown in FIG. 9, the limit portion 113 has a long strip shape, which is protrudingly formed on a surface of the seat 11 and is integrally formed with the seat 11. The number of the limit portion 113 may be set according to requirements, for example, set as two portions, which are symmetrically distributed on both sides of the fixing through hole 111. In this embodiment, as shown in FIG. 9, the limit portion 113 is located on a symmetrically-distributed connecting line of the button hole 15. The limit portion 113 is used to cooperate with the limit hole 1423 on the button linkage 14 to act as a limiting guide, so as to ensure that the button linkage 14 maintains linear movement along a setting direction of the limit portion 113. As shown in FIG. 9, in some embodiments, the limit portion 113 has one end facing the button hole 15 and the other end integrally connected to or integrally formed with the guiding portion 112. In some embodiments, the limit portion 113 may also be separated from the guiding portion 112 by a certain distance.

In some embodiments, as shown in FIGS. 1 to 8, the button linkage 14 is configured as an integrated structure. In some embodiments, as shown in FIGS. 9 to 13, the button linkage 14 is configured as a split structure, which includes a first button linkage 14A and a second button linkage 14B that are divided into two. A structure formed by the coupling of the first button linkage 14A and the second button linkage 14B is basically the same as an integral structure of the button linkage 14. Dividing the button linkage 14 into the first button linkage 14A and the second button linkage 14B has the advantages of prevent unlocking in one side, completing locking only by simultaneously pressing the first button linkage 14A and the second button linkage 14B and being not to unlock only by pressing one of the two button linkages, so that misoperations in unlocking may be avoided to improve safety of use.

In some embodiments, as shown in FIG. 9, when the button linkage 14 is divided into the first button linkage 14A and the second button linkage 14B, a blocking portion 114 may be disposed on the seat 11. The blocking portion 114 is used to separate and abut the first button linkage 14A and the second button linkage 14B. The blocking portion 114 is in a plate shape, and protruded from the surface of the seat 11. The blocking portion 114 is perpendicular to the movement direction of the moving portion 141. In this embodiment, the blocking portion 114 is perpendicular to the limit portion 113, and there are two blocking portions 114, which are symmetrically distributed on both sides of the fixing through hole 111. One end of the blocking portion 114 may be integrally formed with the guiding portion 112, or may be spaced apart from the guiding portion 112 by a certain distance. In this embodiment, the blocking portion 114 is integrally formed with the guiding portion 112.

To facilitate mounting the first magnet 18, in different embodiments, different structures may be arranged to fix the first magnet 18. For example, in some embodiments, as shown in FIGS. 2 to 8, a magnet fixing base 13 may be disposed between the upper cover 12 and the seat 11 to dispose the first magnet 18 on the magnet fixing base 13. In some embodiments, as shown in FIGS. 9 to 13, a magnet fixing portion 116 may be disposed on a top of the guiding portion 112 to dispose the first magnet 18 in the magnet fixing portion 116.

In some embodiments, as shown in FIGS. 9 to 13, the magnet fixing portion 116 is integrally formed with or integrally connected to the guiding portion 112, and is directly opposite to the fixing through hole 111 as well as being spaced apart from the fixing through hole 111 by a certain distance. The magnet fixing portion 116 is provided with a first magnet mounting slot 131, and the first magnet mounting slot 131 is directly opposite to the fixing through hole 111 with an opening direction opposite to the fixing through hole 111. The first magnet 18 is disposed in the first magnet mounting slot 131. The shape and size of the first magnet 18 are preferably consistent with the fixing through hole 111. The first magnet mounting slot 131 is preferably a circular hole, and the first magnet 18 is preferably a circular magnet.

In some embodiments, as shown in FIGS. 2 to 8, the magnet fixing base 13 is provided with a first magnet mounting slot 131, and the first magnet mounting slot 131 is directly opposite to the fixing through hole 111 with an opening direction opposite to the fixing through hole 111. The first magnet 18 is disposed in the first magnet mounting slot 131. The shape and size of the first magnet 18 are preferably consistent with the fixing through hole 111. In this embodiment, the first magnet mounting slot 131 is preferably a circular hole, and the first magnet 18 is preferably a circular magnet. The magnet fixing base 13 may be fixedly connected to the seat 11 by screw fixing. In some embodiments, the magnet fixing base 13 may also be configured to be integrally formed with the upper cover 12 or the seat 11, or fixed on the upper cover 12 or the seat 11. In order to facilitate insertion of the unlocking portion 142 between the parts where the lock tongue 21 is combined with the buckle base assembly 10 to reduce the attraction between the magnets during unlocking, a third guide inclined surface 132 may be disposed on an outer wall of the first magnet mounting slot 131. The third guide inclined surface 132 may be ring-shaped, or may be partially spaced on the outer wall of the first magnet mounting slot 131. The existence of the third guide inclined surface 132 may make the outer wall of the first magnet mounting slot 131 inclined toward the fixing through hole 111.

In order to make the first magnet 18 have a certain degree of freedom of movement, in some embodiments, as shown in FIG. 2, the first magnet mounting slot 131 on the magnet fixing base 13 may be configured to be fixedly connected to the seat 11 through supporting arms 134. The supporting arms 134 are symmetrically disposed, and are respectively formed by extending outward from the outer wall of the first magnet mounting slot 131 and bending downward. The supporting arms 134 arch the first magnet mounting slot 131 at its center, and the structure of the supporting arm 134 allows it to undergo certain elastic deformation, so that the first magnet mounting slot 131 on the magnet fixing base 13 may be slightly displaced in the locking direction.

In order to facilitate displacement and resetting of the first magnet 18, in some embodiments, as shown in FIG. 2, claw portions 133 may be disposed on the magnet fixing base 13. The claw portions 133 are symmetrically disposed, with one end connected to the outer wall of the first magnet mounting slot 131 and the other end extending outward to form a free end, thereby having a certain elasticity. The claw portion 133 has an arch shape, with an arched portion abutting the upper cover 12 to facilitate the resetting of the first magnet mounting slot 131. When the first magnet mounting slot 131 is compressed, the first magnet mounting slot 131 and the first magnet 18 are slightly displaced along the direction of the upper cover 12, and then, the claw portion 133 is compressed. When the first magnet mounting slot 131 loses the external pressing force, an elastic force of the claw portion 133 may push the first magnet mounting slot 131 and the first magnet 18 to reset in a direction away from the upper cover 12, so that the first magnet 18 leans against the lock hole 17.

In some embodiments, as shown in FIG. 9, in order to prevent the button linkage 14 from being stuck in the key hole 15 and unable to come out when pressed, guide plates 115 may be disposed on both sides of the button hole 15 respectively, and a length of the guide plate 115 is slightly larger than a length of the moving portion 141. Therefore, when the moving portion 141 is pressed into place, both sides of the moving portion 141 are restrained by the guide plates 115 and will not be caught, thereby avoiding failure.

In some embodiments, as shown in FIGS. 2 to 8, the button linkage 14 is an integral structure, which is disposed between the magnet fixing base 13 and the seat 11, and includes the moving portion 141, a locking portion 142, a connecting arm 143, an adjusting portion 144, an elastic arm 146 and a functional portion. The moving portion 141 includes the first moving portion 141A and the second moving portion 141B, wherein the first moving portion 141A is connected to the second moving portion 141B by the connecting arm 143. The first moving portion 141A, the connecting arm 143 and the second moving portion 141B are formed integrally with each other or connected integrally with each other in a ring shape with elasticity. The moving portion 141, the connecting arm 143, the adjusting portion 144, the unlocking portion 142, the elastic arm 146, and the functional portion are integrally formed or integrally connected together, wherein the specific material can be set according to requirements. For example, the material may be a plastic material or a metal material.

In some embodiments, as shown in FIGS. 9 to 13, the button linkage 14 is configured as a split structure, which is disposed between the seat 11 and the upper cover 12, including the first button linkage 14A and the second button linkage 14B. The first button linkage 14A and the second button linkage 14B are symmetrical with each other, and they are aligned to form the button linkage 14. The first button linkage 14A includes a first moving portion 141A, a first unlocking portion 142A, a first connecting arm 143A, a first adjusting portion 144A, a first elastic arm 146A, and a first functional portion that are formed integrally. The second button linkage 14B includes a second moving portion 141B, a second unlocking portion 142B, a second connecting arm 143B, a second adjusting portion 144B, a second elastic arm 146B, and a second functional portion that are formed integrally.

The first moving portion 141A and the second moving portion 141B may form the moving portion 141 of the present invention. The first unlocking portion 142A and the second unlocking portion 142B may form the unlocking portion 142 of the present invention. The first connecting arm 143A and the second connecting arm 143B may form the connecting arm 143 of the present invention. The first adjusting portion 144A and the second adjusting portion 144B may form the adjusting portion 144 of the present invention. The first elastic arm 146A and the second elastic arm 146B may form the elastic arm 146 of the present invention. The first functional portion and the second functional portion may form the functional portion of the present invention.

As shown in FIGS. 1 to 13, the moving portion 141 (the first moving portion 141A and the second moving portion 141B) are used for being pressed by the user, are disposed opposite to each other, and respectively penetrates the key hole 15 on both sides of the seat 11 and the upper cover 12 while protruding to the outside for being pressed. The shape and size of the moving portion 141 may be set according to requirements. In order to instruct the user how to operate, an indicator icon may be disposed on the surface of the moving portion 141, such as an arrow indicating the pressing direction.

In some embodiments, as shown in FIGS. 1 to 8, when the button linkage 14 is an integral structure, the connecting arm 143 is connected between the moving portion 141, i.e., between the first moving portion 141A and the second moving portion 141B, and the connecting arm 143 and the moving portion 141 are connected in a ring shape with a certain elasticity to be elastically deformed. The connecting arms 143 are symmetrically connected between the moving portions 141, i.e., the two connecting arms 143 have the same shape and symmetrical positions. Further, the connecting arm 143 itself is also arranged in a symmetrical structure, so that when the moving portions 141 are pressed toward each other, the connecting arm 143 may arch outwardly and deform synchronously. When the moving portion 141 is released, the connecting arm 143 is reset so that the moving portion 141 moves outwards and resets synchronously. In this embodiment, the connecting arm 143 is arcuate, and has an opening facing inward.

In some embodiments, as shown in FIGS. 9 to 13, when the button linkage 14 is a split structure, the first connecting arms 143A are symmetrically disposed on both sides of the first moving portion 141A. The first connecting arm 143A and the first moving portion 141A form a semi-ring structure. The second connecting arms 143B are symmetrically disposed on both sides of the second moving portion 141B, and the second connecting arm 143B and the second moving portion 141B form a semi-ring structure. When the first connecting arm 143A and the second connecting arm 143B are aligned with each other, the first moving portion 141A, the first connecting arm 143A, the second connecting arm 143B, and the second moving portion 141B are enclosed in a ring shape. The first connecting arm 143A and the second connecting arm 143B are arcuate, so they have a certain amount of elastic deformation and may be used for being pressed to deform. When one end of the first connecting arm 143A or the second connecting arm 143B is blocked by the blocking portion 114, pressing the first moving portion 141A or the second moving portion 141B may deform the first connecting arm 143A or the second connecting arm 143B. When the first moving portion 141A or the second moving portion 141B is released, the first connecting arm 143A or the second connecting arm 143B is reset so that the first moving portion 141A or the second moving portion 141B moves outward synchronously and reset.

The adjusting portion 144 is used to adjust the size of the lock hole 17 for locking and unlocking. In some embodiments, as shown in FIGS. 2 to 8, the adjusting portion 144 is disposed inside the connecting arm 143, and the adjusting portions 144 are spaced apart from each other to be enclosed as a whole to form a ring shape with an inner portion enclosed to protrude the adjusting hole 145, thereby facilitating adjustment of the size of the ring. In some embodiments, as shown in FIGS. 9 to 13, the adjusting portion 144 includes a first adjusting portion 144A and a second adjusting portion 144B, wherein the first adjusting portion 144A is disposed on an inner side of the first connecting arm 143A, and the second adjusting portion 144B is disposed on an inner side of the second connecting arm 143B. The first adjusting portion 144A and the second adjusting portion 144B are spaced apart from each other to be enclosed as a whole to form a ring shape with an inner portion enclosed to protrude the adjusting hole 145, thereby facilitating adjustment of the size of the lock hole 17. The adjusting portion 144 is preferably disposed symmetrically: the first adjusting portion 144A and the second adjusting portion 144B are symmetrical with each other; the two first adjusting portions 144A are disposed symmetrically with respect to a central line of the moving portion 141, and the two second adjusting portions 144B are disposed symmetrically with respect to a central line of the moving portion 141.

As shown in FIGS. 1 to 13, the adjusting hole 145 has an open shape, is directly opposite to the fixing through hole 111, and forms the locking hole 17 together with the fixing through hole 111. In the default state, an inner diameter of the adjusting hole 145 is smaller than an inner diameter of the fixing through hole 111. In order to facilitate the engagement of the lock tongue 21, the adjusting portion 144 is step-shaped, and is provided with an overlapping plane 1441 that may overlap the flange portion 212 of the lock tongue 21. In order to facilitate the lock tongue 21 to enter the adjusting hole 145, an edge of the adjusting portion 144 is provided with a first guide inclined surface 1442 that is flared toward the fixing through hole 111 with guiding function, so that the lock tongue 21 slides into the adjusting hole 145 along the first guide inclined surface 1442.

As shown in FIGS. 1 to 13, in order to facilitate the lock tongue 21 to enter the adjustment hole 145 smoothly due to magnetic attraction, the adjustment hole 145 should better adapt to the pressing of the lock tongue 21. If the adjusting portion 144 is hard and requires a large force to be pressed, the lock tongue 21 may be unable to enter the adjusting hole 145 smoothly under the action of the magnetic force. To avoid this situation, an elastic arm 146 is also disposed between the connecting arm 143 and the adjusting portion 144 for providing a certain free displacement space for the adjusting portion 144, so that it can adapt to the pressing of the lock tongue 21.

Figure 5:
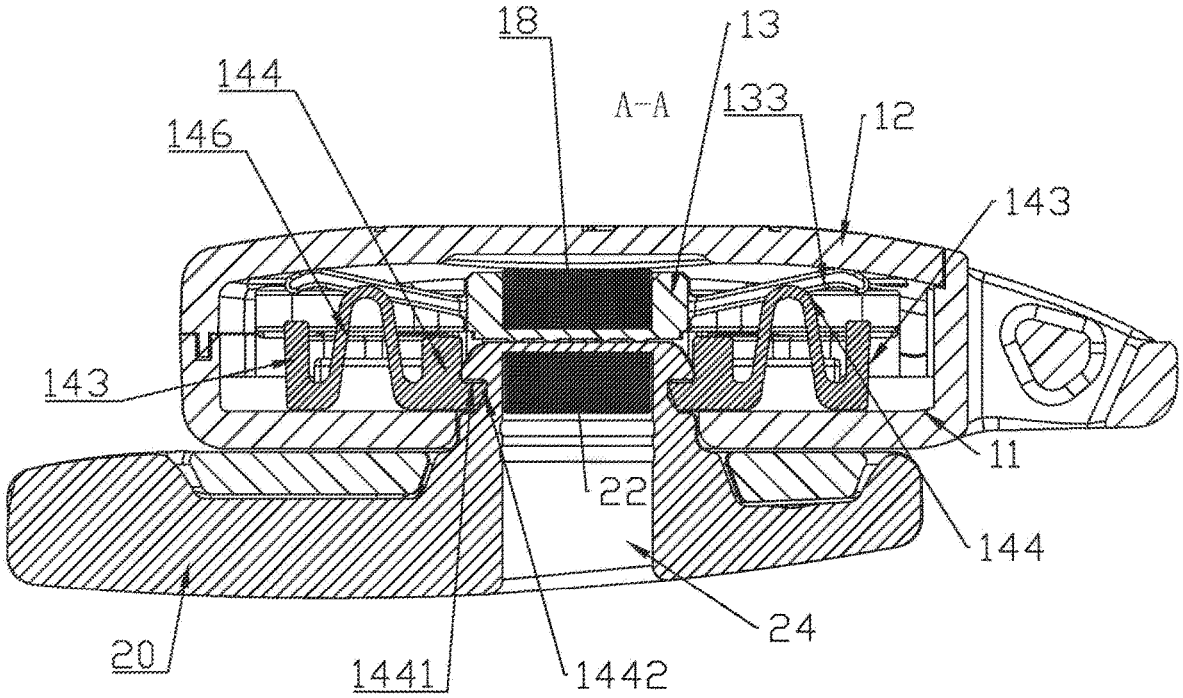
FIG. 5 is a longitude-sectional view along a direction A-A in FIG. 4.
Figure 6:
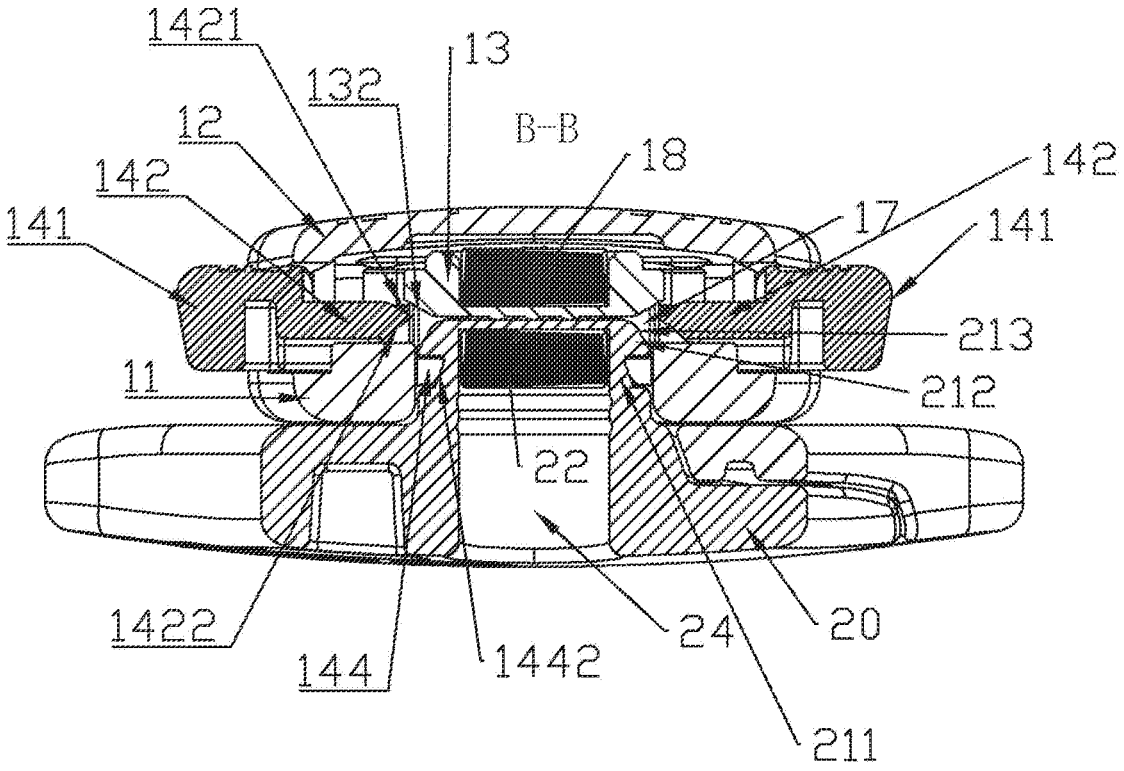
FIG. 6 is a longitude-sectional view along a direction B-B in FIG. 4.
Figure 7:
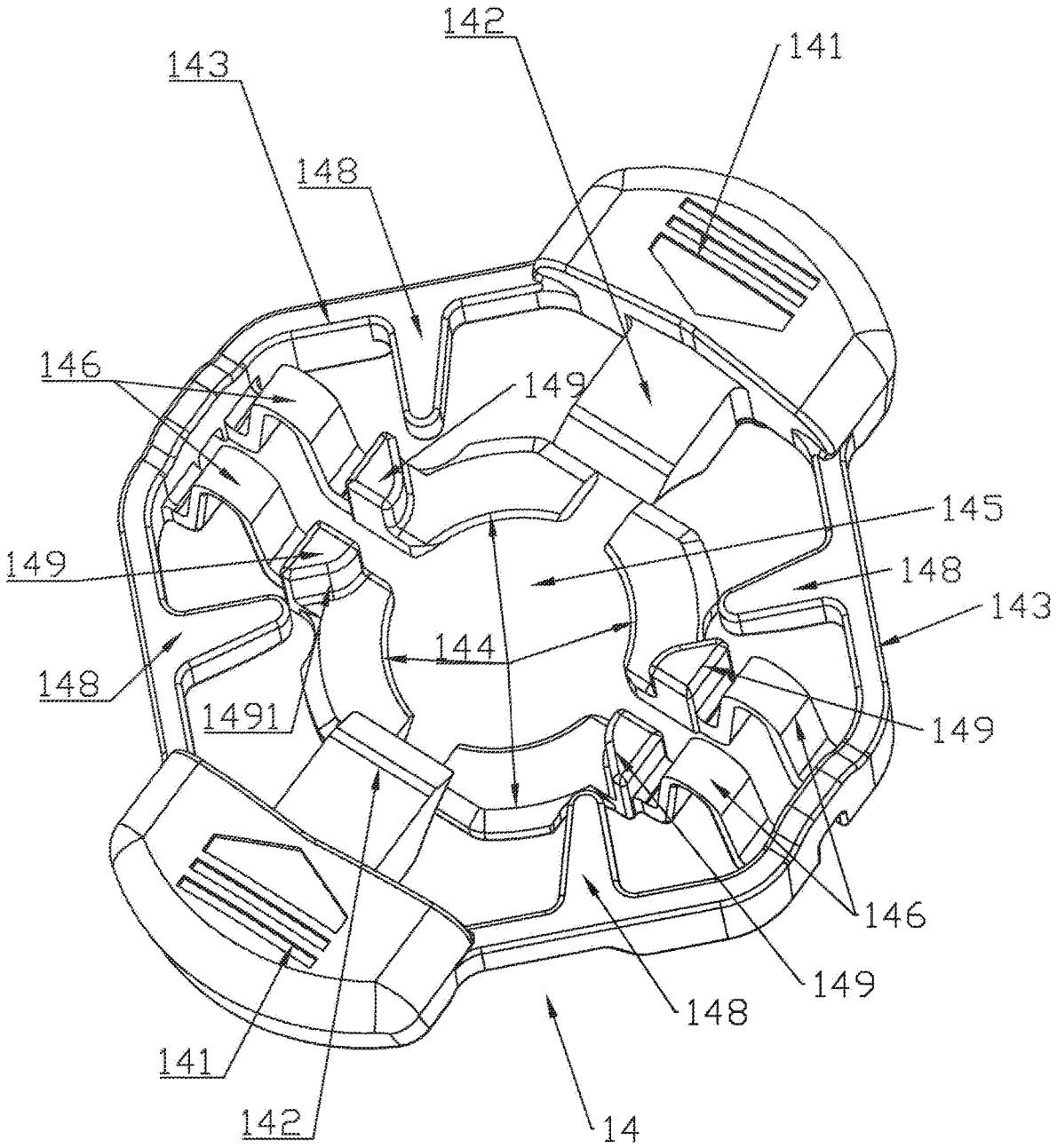
FIG. 7 is a diagram showing a structure when a button linkage is an integral structure.
Figure 8:
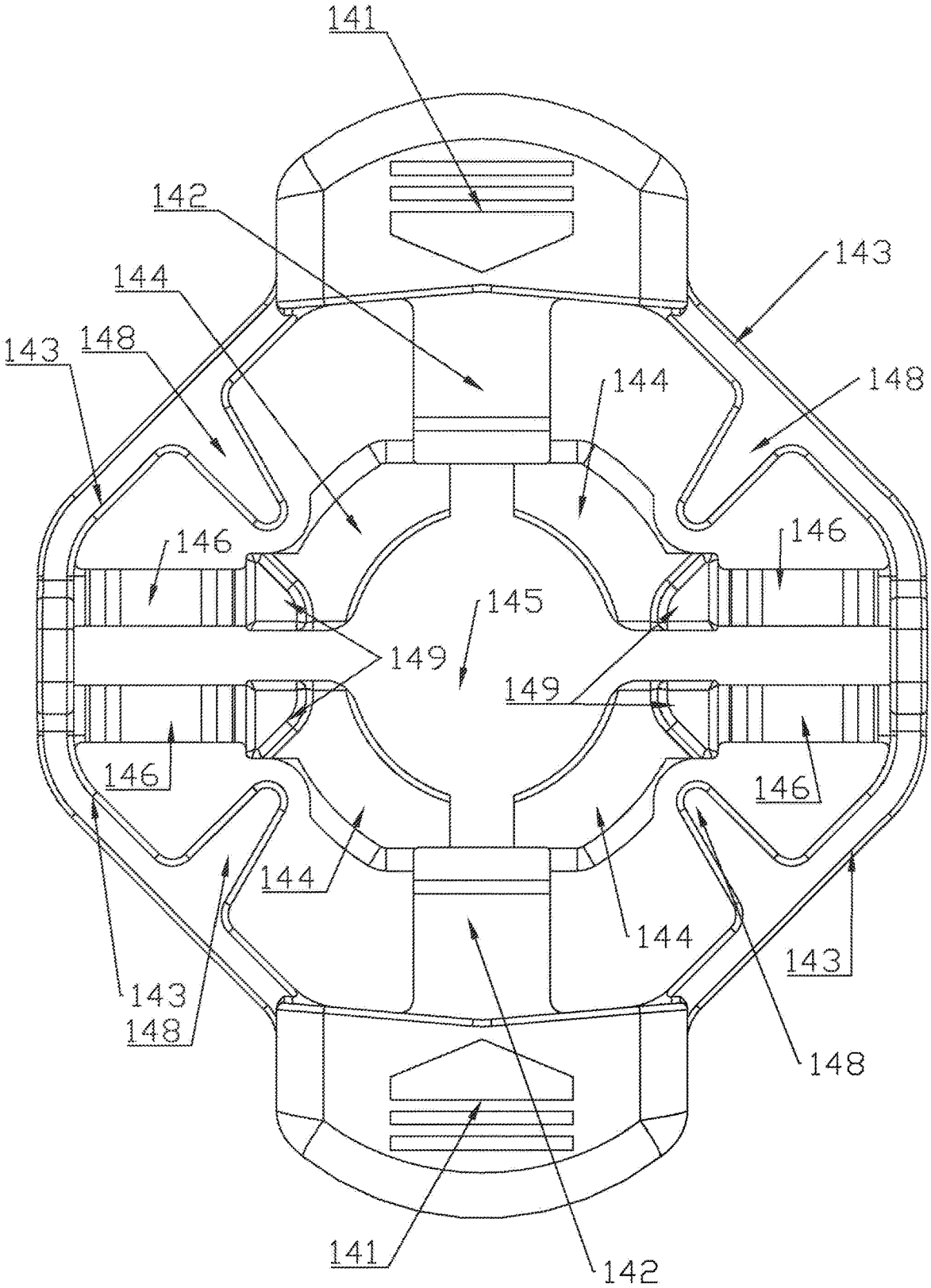
FIG. 8 is a plan view of the structure of FIG. 7.

In some embodiments, as shown in FIGS. 2 to 8, the elastic arm 146 is respectively connected between the connecting arm 143 and the adjusting portion 144, being arched and having a certain elasticity. For example, as shown in FIG. 7, there are two sets of elastic arm 146, wherein each set has two elastic arms 146 symmetrically distributed. Each set of elastic arms 146 are respectively connected between the connecting arm 143 and the adjusting portion 144, and two elastic arms 146 in each set of elastic arms 146 are separated by a certain distance, and they are respectively connected to the adjusting portion 144. In other words, each of the adjusting portions 144 spaced apart from each other may be connected to the connecting arm 143 through the elastic arm 146 respectively.

In some embodiments, as shown in FIGS. 9 to 13, the elastic arm 146 includes a first elastic arm 146A and a second elastic arm 146B. The first elastic arm 146A is disposed between the first connecting arm 143A and the first adjusting portion 144A, and the second elastic arm 146B is disposed between the second connecting arm 143B and the second adjusting portion 144B. The elastic arm 146 is connected between the connecting arm 143 and the adjusting portion 144, being arched and having a certain elasticity. The elastic arm 146 is symmetrically disposed, i.e., the first elastic arm 146A and the second elastic arm 146B are symmetrical with each other, and the first elastic arm 146A and the second elastic arm 146B are also symmetrically distributed.

The number of the elastic arms 146 may be set according to requirements. Generally, the number of the elastic arms 146 is the same as the number of the adjusting portions 144, such as four elastic arms 146, including two first elastic arms 146A and two second elastic arms 146B, wherein two first elastic arms 146A are respectively connected between the first adjusting portion 144A and the first connecting arm 143A, and two second elastic arms 146B are respectively connected between the second adjusting portion 144B and the second connecting arm 143B.

The elastic arm 146 may be connected in the middle of the adjusting portion 144, or may be connected at one end of the adjusting portion 144. In this embodiment, the elastic arm 146 may be connected at one end of the adjusting portion 144 respectively. The specific shape and number of the elastic arms 146 may be set according to requirements, as long as the adjusting portion 144 have a certain elastic displacement. The elastic arm 146 may be V-shaped, or U-shaped, or similar to V-shaped, or similar to U-shaped, and its opening direction faces the fixing through hole 111, with one end connected to the connecting arm 143 and the other end connected to the adjusting portion 144.

In this embodiment, as shown in FIGS. 2 to 8, a space between the two elastic arms 146 in each set of elastic arms 146 may respectively correspond to the claw portion 133 of the magnet fixing base 13, so that the claw portion 133 is located between the two elastic arms 146. In this way, the claw portion 133 may further provide a restraining effect to ensure that the elastic arm 146 may move along the direction of the claw portion 133 when the connecting arm 143 is elastically deformed, thereby ensuring the direction of elastic deformation of the elastic arm 146.

As shown in FIGS. 2, 3, 4, 9 and 10, in order to prevent the adjusting portion 144 used to adjust the size of the lock hole 17 from being pressed and unable to expand smoothly to expand the lock hole 17 during unlocking, a functional portion linked by the moving portion 141 is disposed on the elastic arm 146, which is used to force the adjusting portion 144 to expand outward during unlocking for assisting the lock hole 17 to expand, thereby facilitating the lock tongue 21 to move out of the lock hole 17.

The functional portions (first functional portion and second functional portion) respectively include a pressure receiving portion 149 and a pressing portion 148. As shown in FIGS. 4, 7, 8, 9 and 10, the pressure receiving portion 149 is disposed on the adjusting portion 144, the pressing portion 148 is connected to the connecting arm 143, and an end of the pressing portion 148 faces the pressure receiving portion 149. In the default state, the end of the pressing portion 148 is separated from the pressure receiving portion 149 by a certain distance. When the moving portions 141 are pressed toward each other, the connecting arm 143 expands outward, so that the end of the pressing portion 148 may act on a surface of the pressure receiving portion 149, and squeezing the pressure receiving portion 149 to move the pressure receiving portion 149 outward to further drive the adjusting portion 144 to expand outward, thereby assisting in achieving expansion of the lock hole 17. The pressure receiving portion 149 may be integrally formed with the adjusting portion 144, or may be fixed on the adjusting portion 144. In this embodiment, the pressure receiving portion 149 may be integrally formed with the adjusting portion 144, and the pressure receiving portion 149 is respectively disposed on the surface of each adjusting portion 144 (the first adjusting portion 144A and the second adjusting portion 144B), wherein the pressure receiving portion 149 protrudes from the adjusting portion 144, a guide pressing surface 1491 is disposed on the pressure receiving portion 149, and the pressing surface 1491 may interact with the pressing portion 148 so that the pressing portion 148 may push the pressure receiving portion 149. The pressing portion 148 may be integrally formed with the connecting arm 143, or may be fixed on the connecting arm 143. In this embodiment, the pressing portion 148 may be integrally formed with the connecting arm 143, is symmetrically distributed on the connecting arm 143 and located between the unlocking portion 142 and the elastic arm 146. In the other embodiments, the pressing portion 148 may further be disposed at other positions, and may press the pressure receiving portion 149 as long as the adjusting portion 144 is forced to expand outward.

As shown in FIGS. 2 to 13, the unlocking portion 142 is used to separate parts where the lock tongue 21 is combined with the buckle base assembly 10, i.e., to separate the bottoms of the lock tongue 21 and the first magnet mounting slot 131, so as to weaken the attraction between the first magnet 18 and the second magnet 22 to facilitate unlocking.

The unlocking portion 142 is disposed on an inner wall of the moving portion 141, and is linked by the moving portion 141.

As shown in FIGS. 2 to 8, in some embodiments, when the button linkage 14 is an integral structure, there are at least two unlocking portions 142, which respectively protrude from the inner wall of the moving portion 141 and are spaced apart from each other. The unlocking portions 142 face the adjusting hole 145.

As shown in FIGS. 9 to 13, in some embodiments, when the button linkage 14 is a split structure, the unlocking portion 142 includes a first unlocking portion 142A and a second unlocking portion 142B. The first unlocking portion 142A protrudes from the inner wall of the first moving portion 141A, the second unlocking portion 142B protrudes from the inner wall of the second moving portion 141B, and the first unlocking portion 142A and the second unlocking portion 142B are oppositely spaced apart from each other. The first unlocking portion 142A and the second unlocking portion 142B face the adjusting hole 145 respectively.

As shown in FIGS. 2 to 13, free ends of the unlocking portions 142 (the first unlocking portion 142A and the second unlocking portion 142B) are provided with an inclined wedge surface, which have a guiding function for easy access between the lock tongue 21 and the bottom of the first magnet mounting slot 131, so that the lock tongue 21 is separated from the first magnet mounting slot 131 by a certain distance to reduce the attractive force between the first magnet 18 and the second magnet 22.

In some embodiments, the inclined wedge surface may include a first inclined wedge surface 1421 and a second inclined wedge surface 1422, and the first inclined wedge surface 1421 and the second inclined wedge surface 1422 have opposite inclination directions and are collinear, so that the free ends of the unlocking portion 142 (the first unlocking portion 142A and the second unlocking portion 142B) are sharp with two inclined wedge surfaces to facilitate insertion. An inclination angle of the first inclined wedge surface 1421 is related to an inclination angle of a third guide inclined surface 132 on an outer wall of the first magnet mounting slot 131, and the inclination angle of the first inclined wedge surface 1421 may press the third guide inclined surface 132 to push the magnet fixing base 13 upward along the direction of the upper cover 12, so that the first magnet 18 may be moved upward slightly. An inclination angle of the second inclined wedge surface 1422 is related to inclination angles of a first guide inclined surface 1442 and a second guide inclined surface 213.

In some embodiments, as shown in FIG. 9, in order to limit the movement direction of the first button linkage 14A and the second button linkage 14B, the first unlocking portion 142A and the second unlocking portion 142B are respectively provided with a limit hole 1423. The limit hole 1423 is disposed along the movement direction of the moving portion 141, with a shape and a size matching the shape and size of the limit portion 113 on the seat 11. The limit hole 1423 may be set as an elongated hole, which separates the first unlocking portion 142A and the second unlocking portion 142B into two parallel and separate portions, respectively. In other embodiments, the limit hole 1423 may further be provided with a long strip-shaped slot, which may also match the limit portion 113 to play a limiting and guiding role. For an assembled buckle, the limit portion 113 of the seat 11 is located in the limit hole 1423, so as to play a limiting and guiding role.

In some embodiments, as shown in FIGS. 2 to 8, the seat 11, the upper cover 12, the magnet fixing base 13, the button linkage 14, and the first magnet 18 may form the buckle base assembly 10. The seat 11 is provided with the fixed through hole 111, and the button linkage 14 is provided with the adjusting hole 145 with a default size smaller than that of the fixing through hole 111, so that the fixing through hole 111 and the adjusting hole 145 form the lock hole 17. The first magnet 18 is mounted in the buckle base assembly 10 through the magnet fixing base 13, faces the lock hole 17, and is separated from the lock hole 17 by the magnet fixing base 13 by a certain thickness. The moving portion 141 of the button linkage 14 is partially located outside to be used for being pressed, with the connecting arm 143 and the elastic arm 146 being able to be deformed, so that the size and displacement of the adjusting hole 145 are adjusted. In the default state, the adjusting hole 145 is smaller than the fixing through hole 111, and the connecting arm 143 and the elastic arm 146 may be elastically deformed, so that the lock tongue 21 may be pressed into the lock hole 17 and clamped by the adjusting portion 144 to achieve locking. When the moving portions 141 are pressed toward each other oppositely, the connecting arm 143 is arched outward synchronously, and the adjusting portion 144 may be ensured to expand outwards under the action of the functional portion, so that the lock hole 17 is expanded for moving the lock tongue 21 out of lock hole 17 for unlocking, while the unlocking portion 142 moving toward each other oppositely to be inserted between the lock tongue 21 and the bottom of the first magnet mounting slot 131 to separate them by a certain distance, thereby facilitating lock tongue 21 to move out of the lock hole 17.

In some embodiments, as shown in FIGS. 9 to 13, the seat 11, the upper cover 12, the button linkage 14, and the first magnet 18 may form the buckle base assembly 10. The seat 11 is provided with the fixed through hole 111, and the button linkage 14 is provided with the adjusting hole 145 with a default size smaller than that of the fixing through hole 111, so that the fixing through hole 111 and the adjusting hole 145 form the lock hole 17. The first magnet 18 is mounted in the buckle base assembly 10, faces the lock hole 17, and is separated from the lock hole 17 by the magnet fixing portion 116 with a certain thickness. The moving portion 141 of the button linkage 14 is partially located outside to be used for being pressed, with the connecting arm 143 and the elastic arm 146 being able to be deformed, so that the size and displacement of the adjusting hole 145 are adjusted. In the default state, the adjusting hole 145 is smaller than the fixing through hole 111, and the connecting arm 143 and the elastic arm 146 may be elastically deformed, so that the lock tongue 21 may be pressed into the lock hole 17 and clamped by the adjusting portion 144 to achieve locking. When the first moving portion 141A and the second moving portion 141B are pressed toward each other oppositely, the ends of the first connecting arm 143A and the second connecting arm 143B abut on the blocking portion 114, the first connecting arm 143A and the second connecting arm 143B are elastically deformed under the action of the blocking portion 114, and the adjusting portion 144 may be ensured to expand outwards, so that the lock hole 17 is expanded under the action of the functional portion for moving the lock tongue 21 out of lock hole 17 for unlocking, while the unlocking portion 142 moving toward each other oppositely to the combined position of the first magnet 18 and the second magnet 22 to be inserted between the lock tongue 21 and the bottom of the first magnet mounting slot 131 to separate them by a certain distance, thereby greatly reducing the attraction of the first magnet 18 and the second magnet 22 and moving easily the lock tongue 21 out of the lock hole 17 for achieving unlocking. When the first moving portion 141A or the second moving portion 141B is individually pressed, one end of the first connecting arm 143A or the second connecting arm 143B abuts the blocking portion 114 while the other end remaining stationary, and then only one of the first connecting arm 143A and the second connecting arm 143B is deformed while the other part remaining stationary, so that the lock hole 17 will only be partially expanded, while the other part of the structure is still locked, thereby making the entire lock tongue 21 unable to be moved out for unlocking. Therefore, by configuring the button linkage 14 into two linkages, the problem of unlocking with one side may be effectively solved, so that the magnetic buckle may be unlocked only by simultaneously pressing the first moving portion 141A and the second moving portion 141B.

As shown in FIGS. 2, 5, 6 and 9, the locking assembly 20 is provided with the lock tongue 21, and the lock tongue 21 may be integrally formed with or fixedly connected to the locking assembly 20. In this embodiment, the lock tongue 21 is integrally formed on one side surface of the locking assembly 20 facing the lock hole 17. The lock tongue 21 includes a columnar portion 211 and a flange portion 212. The columnar portion 211 protrudes from the surface of the locking assembly 20, and the flange portion 212 is disposed on a free end of the columnar portion 211 and integrally formed with the columnar portion 211. An outer dimension of the flange portion 212 is larger than an outer diameter of the columnar portion 211, so that a clamping step is formed between the flange portion 212 and the columnar portion 211. In this embodiment, the columnar portion 211 is cylindrical, with the outer diameter smaller than an inner diameter of the fixing through hole 111. The outer diameter of the flange portion 212 is smaller than the inner diameter of the fixing through hole 111 and larger than an inner diameter of the adjusting hole 145 in the default state. In order to facilitate the lock tongue 21 to enter the lock hole 17, a free end of the flange portion 212 of the lock tongue 21 is provided with the second guide inclined surface 213 in a narrowing shape, which has a guiding function. The provision of the guide inclined surface 213 makes the flange portion 212 have a truncated cone shape as a whole. An inclination angle of the second guide inclined surface 213 is consistent with or substantially the same as inclination angles of a first guide inclined surface 1442 and a second inclined wedge surface 1422. In order to facilitate the connection of the webbing, a second webbing hole 23 is disposed on the locking assembly 20. The structure of the second webbing hole 23 may be set according to requirements.

As shown in FIGS. 2, 5 and 6, in order to mount the second magnet 22, in some embodiments, an inner portion of the lock tongue 21 is hollow to form a second magnet mounting slot 24. The second magnet 22 has a circular shape, is fixedly mounted in the second magnet mounting slot 24, and may be fastened by a known structure, e.g., blocked by a removable cover plug.

The buckle base assembly 10 and the locking assembly 20 may form the magnetic buckle of the present invention.

When the lock tongue 21 of the locking assembly 20 is close to the lock hole 17 of the buckle base assembly 10, the first magnet 18 attracts the second magnet 22, so that the lock tongue 21 may be quickly pressed into the lock hole 17. Since the connecting arm 143 and the elastic arm 146 of the button linkage 14 may be elastically deformed, the size of the adjusting hole 145 is adjustable. When the lock tongue 21 is attracted by the first magnet 18, the lock tongue 21 may press the first guide inclined surface 1442 of the adjusting portion 144 through the second guide inclined surface 213 to be pressed into the lock hole 17. When the lock tongue 21 is pressed into the lock hole 17 under the action of magnetic attraction, the connecting arm 143 is elastically reset so that the adjusting hole 145 is reduced to the default size for making the adjusting portion 144 be clamped at the step between the columnar portion 211 and the flange portion 212 of the lock tongue 21, thereby achieving locking.

In some embodiments, as shown in FIGS. 2 to 8, for the magnetic buckle where the magnet fixing base 13 is arranged to mount the first magnet 18, the magnet fixing base 13 may further reduce the unlocking force and avoid failures in unlocking. When unlocking is required, the moving portions 141 are pressed toward each other oppositely. Then, the unlocking portion 142 first contacts the third guide inclined surface 132 of the first magnet mounting groove 131 as the moving portions 141 move toward each other, and the first inclined wedge surface 1421 of the unlocking portion 142 presses the third guide inclined surface 132 to cause the magnet fixing base 13 to move slightly toward the upper cover 12 while the first magnet 18 attracting the second magnet 22. Then, the lock tongue 21 will also move slightly synchronously under the action of magnetic attraction when the magnet fixing base 13 moves slightly toward the upper cover 12, and then the lock tongue 21 moving toward the upper cover 12 causes the flange portion 212 to be separated from the overlapping plane 1441 of the adjusting portion 144, so that the adjusting portion 144 moves more freely to prevent the adjusting portion 144 from being pressed and unable to expand outward to release the lock. When the user presses the moving portions 141 toward each other, the connecting arm 143 expands synchronously, which may drive the adjusting portion 144 to expand synchronously while the interaction between the pressing portion 148 and the pressure receiving portion 149 may further assist the expansion movement of the adjusting portion 144 to ensure that the adjusting portion 144 is expanded smoothly without being pressed, thereby easily making the adjusting hole 145 larger and unable to hold the flange portion 212 of the lock tongue 21. As the unlocking portion 142 continues to move, the unlocking portion 142 will be pressed between the lock tongue 21 and the bottom of the first magnet mounting slot 131, so that the lock tongue 21 is spaced apart from the bottom of the first magnet mounting slot 131 by a certain distance, thereby greatly reducing the attractive action between the first magnet 18 and the second magnet 22 and easily moving the lock tongue 21 out of the lock hole 17 for achieving unlocking.

For the magnetic buckle of the present invention, the moving portions 141 are symmetrically disposed, so that the user may press on both sides oppositely, which leads to ergonomic and simple operations. In addition, through the provision of the connecting arm 143 and the elastic arm 146, the adjusting portion 144 may expand in the radial direction, so that the lock tongue 21 may easily press the adjusting portion 144 into the lock hole 17 under the action of a small magnetic attraction, thereby reducing requirements for the magnetic strength of the first magnet 18 and the second magnet 22. Further, the unlocking portion 142 may be pressed into between the lock tongue 21 and the bottom of the first magnet mounting slot 131 to separate parts where the first magnet 18 is combined with the second magnet 22, thereby greatly reducing the attractive force between the first magnet 18 and the second magnet 22 for facilitating unlocking. For the magnetic buckle with magnet fixing base, the unlocking portion 142 may first move the first magnet 18 along a direction away from the lock hole 17 to drive the lock tongue 21 to move upward, so that the lock tongue 21 may not compress the adjusting portion 144 to facilitate the expansion of the adjusting portion 144 and to expand the adjusting hole 145 for unlocking, thereby greatly reducing the unlocking force. For the magnetic buckle with magnet mounting slot, the magnet mounting slot is fixed on the guiding portion 112 and has a constant distance from the lock hole 17, so that the adjusting portion 144 may not be pressed to prevent the expansion of the adjusting portion 144, thereby avoiding the problem that unlocking is not performed as the adjusting portion 144 is clamped. By configuring the button linkage 14 into two linkages, the problem of unlocking with one side can be effectively avoided. Unlocking may not be performed by pressing the moving portion 141A or the second moving portion 141B singly, but may be performed by pressing them simultaneously, thus further improving the safety. The magnetic buckle of the present invention is not only simple to operate, but also labor-saving, and has strong safety, as well as having strong practicability.

Although the present invention has been disclosed through the above embodiments, the scope of the present invention is not limited thereto. Without departing from the concept of the present invention, the above components can be replaced with similar or equivalent elements understood by those skilled in the art.

What is claimed is:

1. A magnetic buckle, comprising:

a buckle base assembly and a locking assembly, wherein a first magnet and an adjustable lock hole are disposed on the buckle base assembly, a lock tongue capable of insertion into the lock hole and a second magnet are disposed on the locking assembly, two moving portions are disposed at two opposite sides of the buckle base assembly respectively, two unlocking portions linked by the two moving portions are disposed within the buckle base assembly, and the unlocking portions face the lock hole;

when the lock hole of the buckle base assembly is close to the lock tongue of the locking assembly, the first magnet attracts the second magnet to guide the lock tongue into the lock hole to achieve locking;

when the moving portions are pressed toward each other, the unlocking portions move toward parts of the lock tongue combined with the buckle base assembly to separate the parts of the lock tongue combined with the buckle base assembly for reducing an attractive force between the first magnet and the second magnet, so as to facilitate separation between the buckle base assembly and the locking assembly.

2. The magnetic buckle according to claim 1, wherein the buckle base assembly is provided with functional portions each linked by a respective moving portion to force the lock hole to expand; when the moving portions are operated to unlock, the functional portion forces the lock hole to expand for assisting the lock tongue to disengage from the lock hole.

3. The magnetic buckle according to claim 1, wherein each unlocking portion is arranged on an inner wall of a respective moving portion and protrudes from the inner wall of the respective moving portion, and a free end of each unlocking portion is provided with a guiding wedge surface.

4. The magnetic buckle according to claim 1, wherein each moving portion comprises a first moving portion and a second moving portion, two first connecting arms are symmetrically disposed at two sides of the first moving portion, and the first connecting arms are integrally formed with the first moving portion; two second connecting arms are symmetrically disposed at two sides of the second moving portion, and the second connecting arms are integrally formed with the second moving portion; the first connecting arms and the second connecting arms are in a disconnected relationship, which forms a connecting arm with a symmetrical structure; the first moving portion, the first connecting arms, the second connecting arms and the second moving portion are enclosed in an enclosed shape.

5. The magnetic buckle according to claim 4, wherein first adjusting portions capable of adjusting a size of the lock hole are respectively disposed within the first connecting arms, second adjusting portions capable of adjusting the size of the lock hole are respectively disposed within the second connecting arms, and the first adjusting portions and the second adjusting portions are in the enclosed shape with an adjusting hole for adjusting the size of the lock hole formed therebetween.

6. The magnetic buckle according to claim 5, wherein each of two first elastic arms is disposed between a respective first connecting arm and a respective first adjusting portion, each first elastic arm is in an arched shape with elasticity, and each first elastic arm has one end connected to the respective first connecting arm and the other end connected to the respective first adjusting portion; each of two second elastic arms is disposed between a respective second connecting arm and a respective second adjusting portion, each second elastic arm is in an arched shape with elasticity, and each second elastic arm has one end connected to the respective second connecting arm and the other end connected to the respective second adjusting portion.

7. The magnetic buckle according to claim 6, wherein each first/second adjusting portion is provided with a pressure receiving portion, and each first/second connecting arm is provided with a pressing portion; when the moving portions are pressed toward each other for unlocking, an end of each pressing portion acts on a respective pressure receiving portion to press the respective pressure receiving portion to force the respective first/second adjusting portion to expand outward, such that the lock hole is forced to expand.

8. The magnetic buckle according to claim 7, wherein each pressure receiving portion is provided with a pressing surface; each pressure receiving portion is symmetrically disposed on the respective first/second adjusting portion, and each pressing portion is symmetrically disposed on the respective first/second connecting arm.

9. The magnetic buckle according to claim 7, wherein each pressing portion is located between the respective first/second elastic arm and the respective unlocking portion; the respective first/second elastic arm, the respective pressing portion and the respective unlocking portion are located at a periphery of the respective first/second adjusting portion.

10. The magnetic buckle according to claim 5, wherein the buckle base assembly comprises a seat, the seat is provided with a fixing through hole, the adjusting hole is directly opposite to the fixing through hole, and the adjusting hole and the fixing through hole form the lock hole; in a default state, an inner diameter of the adjusting hole is smaller than an inner diameter of the fixing through hole; when the moving portions are pressed toward each other, each first adjusting portion and each second adjusting portion expand outward so that the inner diameter of the adjusting hole is larger than the inner diameter of the fixing through hole.

11. The magnetic buckle according to claim 10, wherein the lock tongue comprises a columnar portion protruding from the locking assembly and a flange portion arranged at a free end of the columnar portion, and a clamping step is formed between the flange portion and the columnar portion; when the lock tongue enters the lock hole, the flange portion presses the first adjusting portions and the second adjusting portions to enter the lock hole, and each first/second adjusting portion is clamped at the clamping step to limit the lock tongue from actively escaping from the lock hole.

12. The magnetic buckle according to claim 11, wherein an edge of each first/second adjusting portion is provided with a first guide inclined surface that is flared toward the fixing through hole, and an outer wall of the flange portion is provided with a second guide inclined surface in a narrowing shape.

13. The magnetic buckle according to claim 10, wherein an inner wall of the seat facing the adjusting hole is provided with a plurality of guiding portions, the guiding portions are distributed on a periphery of the fixing through hole, and ends of the guiding portions face the fixing through hole; the guiding portions are formed integrally with the seat, the guiding portions are protruded from the inner wall of the seat and are distributed circumferentially along the fixing through hole, and the ends of the guiding portions are flush with a circumferential wall of the fixing through hole.

14. The magnetic buckle according to claim 13, wherein a top of the guiding portion is provided with a magnet fixing portion formed or connected integrally therewith, and the magnet fixing portion is directly opposite to the fixing through hole and is spaced apart from the fixing through hole; a first magnet mounting slot is disposed on the magnet fixing portion, and the first magnet is mounted in the first magnet mounting slot.

15. The magnetic buckle according to claim 1, wherein each moving portion comprises a first moving portion and a second moving portion, the first moving portion is connected to the second moving portion by a connecting arm, and the first moving portion, the connecting arm and the second moving portion are formed integrally with each other or connected integrally with each other in a ring shape with elasticity.

16. The magnetic buckle according to claim 4, wherein the buckle base assembly is provided with two blocking portions, and each blocking portion is disposed between a respective first connecting arm and a respective second connecting arm to separate the respective first connecting arm from the respective second connecting arm; when a respective first moving portion or a respective second moving portion is pressed alone, an end of the respective first connecting arm or the respective second connecting arm presses a respective blocking portion to partially expand the lock hole for not being unlocked; when the respective first moving portion and the respective second moving portion are simultaneously pressed, two ends of the respective first connecting arm and the respective second connecting arm press the respective blocking portion simultaneously to expand the lock hole evenly for being unlocked.

17. The magnetic buckle according to claim 1, wherein the buckle base assembly is provided with two limit portions, and each limit portion limits a moving direction of a respective moving portion, a respective unlocking portion is provided with a respective limit hole arranged along the moving direction of the respective moving portion, and the respective limit hole is matched with the respective limit portion.

18. The magnetic buckle according to claim 1, wherein a guiding portion for preventing the lock tongue from tilting relative to a locking direction is disposed in the lock hole.

19. The magnetic buckle according to claim 1, wherein the first magnet is directly opposite to the lock hole and is spaced apart from the lock hole, and the second magnet is directly opposite to the lock tongue.

20. The magnetic buckle according to claim 1, wherein the buckle base assembly comprises a magnet fixing base, the magnet fixing base is provided with a first magnet mounting slot, a position of the first magnet mounting slot is directly opposite to the lock hole, an opening direction of the first magnet mounting slot is opposite to the lock hole, and the first magnet is arranged in the first mounting slot.

* * * * *